US006941136B2

(12) United States Patent
Study et al.

(10) Patent No.: US 6,941,136 B2
(45) Date of Patent: Sep. 6, 2005

(54) METHOD AND APPARATUS FOR MEMORY CLONING FOR A CONTROL DEVICE

(75) Inventors: Robert Study, Arlington Heights, IL (US); Eric Robb, Carol Stream, IL (US); Robert Rainey, Temecula, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/073,662

(22) Filed: Feb. 11, 2002

(65) Prior Publication Data

US 2003/0153306 A1 Aug. 14, 2003

(51) Int. Cl.[7] ..... H04M 3/00
(52) U.S. Cl. ..... 455/419; 455/420; 455/343.3
(58) Field of Search ..... 455/343.3, 127.1, 455/550.1, 572, 575.1, 127.4, 343.4, 419, 420; 340/5.2, 500, 825.69, 825.72, 825.37, 426; 49/31

(56) References Cited

U.S. PATENT DOCUMENTS 4,364,620 A * 12/1982 Mulholland et al.
4,750,118 A * 6/1988 Heitschel et al.
5,418,837 A * 5/1995 Johansson et al.
5,608,612 A 3/1997 Hokao
6,218,956 B1 * 4/2001 Davis et al.
6,231,443 B1 * 5/2001 Asai et al.
6,459,969 B1 10/2002 Bates et al.

OTHER PUBLICATIONS

International Search Report for PCT patent application PCT/US03/03604 completed on Mar. 27, 2003.

* cited by examiner

*Primary Examiner*—David Hudspeth
*Assistant Examiner*—Huy Nguyen
(74) *Attorney, Agent, or Firm*—Fitch, Even, Tabin & Flannery

(57) ABSTRACT

A control device 11 for use with another device (such as a movable barrier operator 12) has multiple memory interfaces 26 and 27 to permit the contents of one memory to be copied to another memory to thereby create an effective clone of the first memory. This copied memory is easily removable from the control device 11 and thereafter stored separately as a back-up memory or used as the main memory in another control device 11. This effectively avoids a need for more tedious registration of authorized remote control transmitters in systems where the control device 11 interfaces with a movable barrier operator 12. In one embodiment, blocking information as corresponds to any of the otherwise registered transmitters can also be copied to the new memory when effecting this process.

8 Claims, 3 Drawing Sheets

11

METHOD AND APPARATUS FOR MEMORY CLONING FOR A CONTROL DEVICE

TECHNICAL FIELD

This invention relates generally to memory management and more particularly to control devices used with movable barrier operators.

BACKGROUND

Various control devices that use memory are known. For example, control devices that receive remote control transmissions from any of a plurality of remote control transmitters and then provide corresponding control signals to a movable barrier operator such that a movable barrier can be remotely controlled by an authorized user often have memory to store information such as unique identifying information that corresponds to authorized transmitters. In some settings, such as an apartment complex, gated community, military base, or multi-building campus, the number of transmitters that may need to be authorized for a given movable barrier can be large, ranging into hundreds of units.

Control devices for such systems are usually programmable in some fashion or another to allow individual transmitters to be effectively registered with the control device so that transmissions for such transmitters will be recognized by the control device and acted upon correspondingly. This registration process can be lengthy and tedious when the number of transmitters to register is large. Unfortunately, redoing such a process can be necessary under a variety of circumstances. For example, the control device can be physically damaged to the point where the memory is also damaged beyond repair. As another example, a new movable barrier may be added to the system, which new movable barrier will have its own corresponding movable barrier operator and control device needing such programming. When such events occur, it can be tedious and time consuming at best to program the new memory. This can be especially troubling because usually the programmer requires access to each individual transmitter itself to effect the registration process with the control device and these transmitters are usually dispersed amongst a user population.

BRIEF DESCRIPTION OF THE DRAWINGS

The above needs are at least partially met through provision of the method and apparatus for memory cloning for a control device described in the following detailed description, particularly when studied in conjunction with the drawings, wherein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. In addition, numerous elements common to such devices, apparatus, and methods and as are otherwise well known in the art are typically not depicted for purposes of more clearly depicting particular aspects of these embodiments.

DETAILED DESCRIPTION

Generally speaking, pursuant to these various embodiments, a control device that is operably coupleable to another device (such as a movable barrier operator) has a housing and, disposed within that housing, a processing unit that communicates with at least two memory physical interfaces. A first memory as removably retained in one of the memory physical interfaces contains information such as, in these embodiments, identifying information for a plurality of remote control transmitters that are registered to operate with the other device to which the control device is coupled. A second memory is placed in operable contact with one of the remaining memory physical interfaces and, upon initiation of a copying program, the information regarding these transmitters is copied from the first memory and written to the second memory. In this way, a cloned memory is readily formed within the form factor of the control device itself and without resort to any other intermediary device.

That cloned memory can then be left in place if desired. Or, the cloned memory can be removed from the control device and stored in a safe place to serve as a back-up replacement should anything happen to the first memory. Or, the cloned memory can be used by placing it in another control device for use as the source of information regarding the transmitters (as may be appropriate when bringing a new movable barrier operator on line within the system). Other uses are appropriate as well as desired by a given user.

Referring now to the figures, a more detailed description will be provided.

Figure 1:
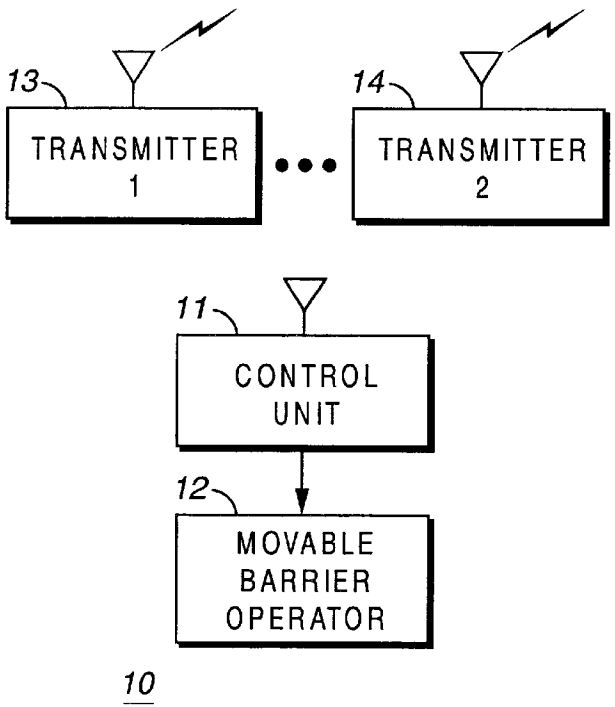
FIG. 1 comprises a block diagram of an embodiment configured in accordance with the invention.

In FIG. 1, a given system 10, in this embodiment, includes a control device 11 that is coupled to a movable barrier operator 12 such that the control device 11 can provide control signals to the movable barrier operator 12 to thereby control, at least to some extent, a movable barrier as operated by the movable barrier operator 12. The control 11 provides such control signals in response to receiving appropriate transmissions from any of a plurality of previously registered remote control transmitters (represented here by transmitter 1 and transmitter 2 as denoted by reference numerals 13 and 14). The number of transmitters supported will vary with the application, and will typically number from one to many hundreds, though 1,000 or more are certainly possible. In this particular embodiment, up to 250 such transmitters are presumed to be supported by the system 10.

Figure 2:
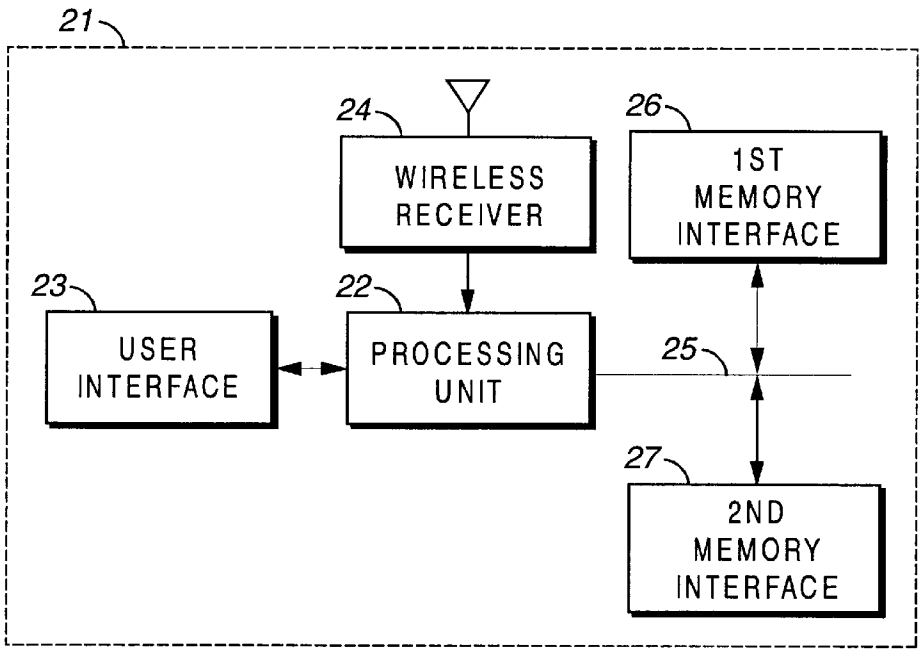
FIG. 2 comprises a block diagram of a control device embodiment configured in accordance with the invention.

Referring now to FIG. 2, the control device 11 includes a housing 21 that may be comprised of an appropriate material (metal or sturdy plastic are typical choices) and will typically have some mechanism to allow user access to at least portions of the interior contents. In this embodiment, within the housing 21 is a processing unit 22, such as a microprocessor with supporting circuitry and outlying components. The processing unit 22 preferably comprises a programmable platform that is programmable to effect the activities described below. The processing unit 22 couples to a user interface 23 which will typically be disposed in a manner that is exposed to the exterior of the housing 21 (more details regarding the user interface 23 are provided below) though, if desired, the user interface 23 can be disposed within the housing 21 as may be appropriate where environmental conditions and/or local regulations urge this configuration. The user interface 23 allows a user to interact directly with the control device 11 to effect, for example, a memory copying routine as described below. In this embodiment, the processing unit 22 also couples to a wireless receiver 24 that at least receives transmissions from various transmitters including the remote control transmitters that are authorized through pre-registration with the control device 11. As well understood in the art, the wireless receiver 24 can be co-located with the processing unit 22 (and can even share the same substrate) or, in the alternative, can be located remotely from the processing unit 22 as appropriate to the application.

In this embodiment, the control device 11 also includes a first and second memory interface 26 and 27 that communicate with the processing unit 22 via a communications bus 25 in accordance with well understood prior art technique. So configured, the processing unit 22 can communicate with the memories. In this embodiment, as depicted, the processing unit 22 can both read and write with respect to the first memory interface 26, but can only write to the second memory interface 27. If desired, of course, the processing unit 22 could also read with respect to the second memory interface 27 as well. The first memory interface 26 is used to interface with a first memory that will contain the effective working memory for the control device 11 (in this case, the identifying information for the authorized transmitters). The second memory interface 27 is used as described below to permit creation of a memory clone within the form factor of the control device 11 itself.

Figure 3:
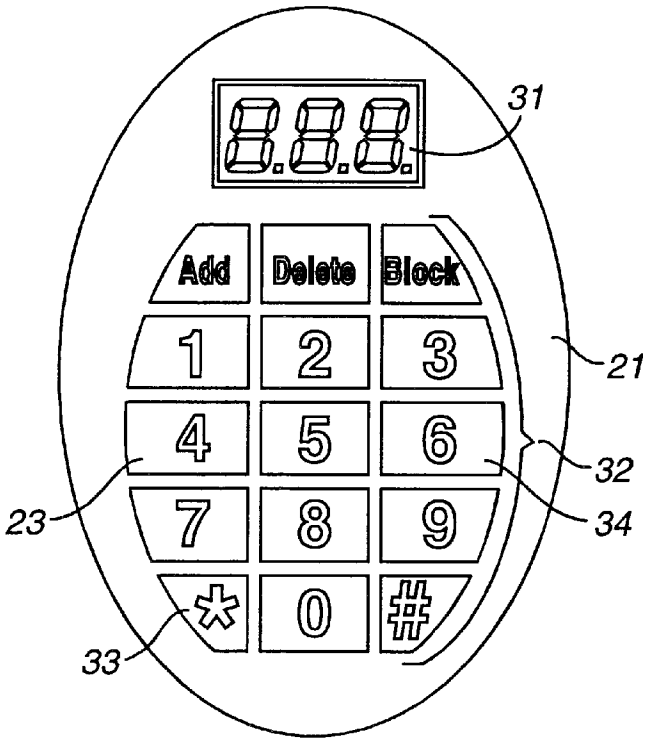
FIG. 3 comprises a side elevational view of an embodiment of a housing and user interface as configured in accordance with the invention.

Referring now to FIG. 3, the housing 21 can be configured with a variety of form factors and in this embodiment has an oval shape. On an exterior surface of the housing 21 the user interface 23 includes a display 31 and a keypad 32. The display allows various information to be presented to the user as appropriate to various supported functionality. The keypad 32 allows a user to enter information and/or express commands to the control device 11. For example, in this embodiment, to initiate a memory copying routine the user simultaneously asserts the asterisk key 33 and the key bearing numeral 6 (as denoted by reference numeral 34).

Figure 4:
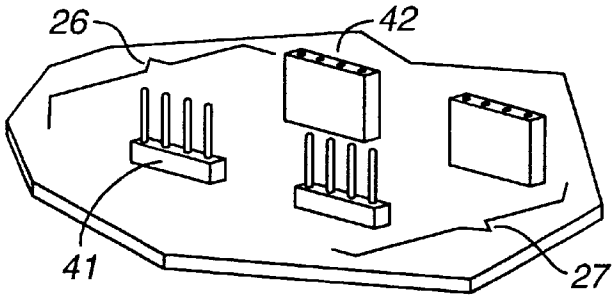
FIG. 4 comprises a detailed perspective view of physical memory interfaces as configured in accordance with the invention.
Figure 5:
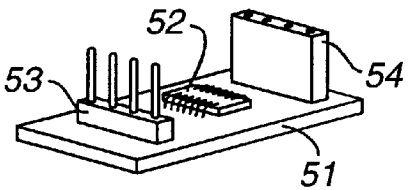
FIG. 5 comprises a perspective view of a memory module as configured in accordance with the invention.

Referring now to FIG. 4, additional detail regarding the memory interfaces 26 and 27 will be provided. Both memory interfaces 26 and 27, in this embodiment are substantially identical to one another. Though not necessarily required, such identity well supports flexible subsequent use of a cloned memory in a variety of ways. Here, each memory interface 26 or 27 is comprised primarily of a set of male 41 and female 42 socket members. Referring momentarily to FIG. 5, a memory module is seen to be comprised correspondingly of a small substrate 51 (made, for example, of printed wiring board material such as FR4) bearing a memory integrated circuit 52 (in this embodiment a 32K electronically erasable random access memory component) having its leads coupled in known fashion to a set of female socket members 54 and male socket members 53. Such a module will readily fit and interface with the earlier described memory interfaces 26 and 27. In this embodiment, the memory module will be held in place by friction and pressure. So configured, the memory module can be easily removed by a user. This ease of removal can be realized in a variety of other ways, of course. For example, an arrangement could be provided whereby the memory module is held in place by clips, snaps, cam surfaces, screws or other similar fasteners, to name a few alternatives. Any such mechanism or approach is appropriate so long as the memory module itself remains relatively easily removed by the user. For example, fastening the memory module in place by soldering electrical contacts on the memory module to corresponding contacts on the control device 11 would typically not result in ease of subsequent removal.

So configured, the control device 11 has two or more memory interfaces 26 and 27 that can each receive a memory module. At least one of the memory modules can contain working information for the control device 11 including identifying information for remote control transmitters that have been authorized for use with the control device 11. Remaining memory interfaces can then be used to receive a memory module to which a user desires to copy the contents of the working information. The user interface 23 is usable to initiate such a copying process.

Figure 6:
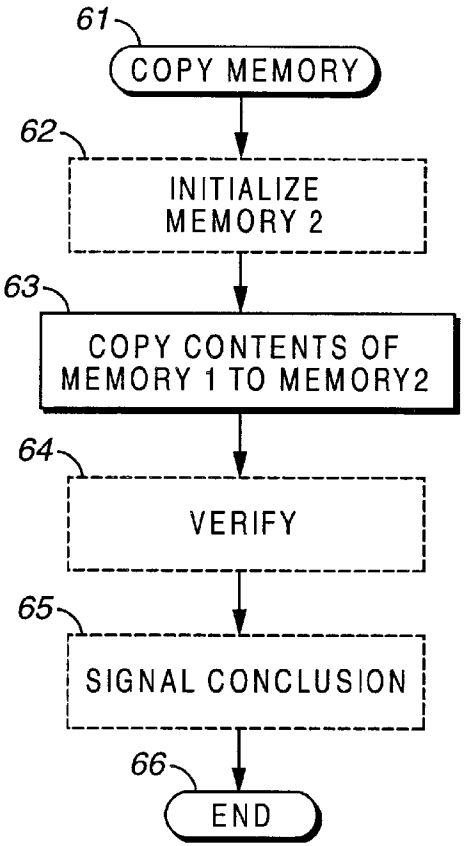
FIG. 6 comprises a flow diagram of an embodiment as configured in accordance with the invention.

Referring now to FIG. 6, by placing memory modules in the memory interfaces 26 and 27 as described above and upon initiating the copying memory process 61, the processing unit 22 can, if desired, initialize 62 the second memory. This optional step will ensure that the contents of the second memory will only include that which the processing unit 22 subsequently writes to it. The contents of the first memory are then copied 63 to the second memory, thereby forming a clone of the first memory. If desired, at least one memory location can be reserved for an indication to confirm that this memory includes information as written to it by the processing unit 22. For example, ASCII characters representing "STAR250" could be written to the second memory for this purpose. If desired, the processing unit 22 could then optionally verify 64 that the contents of the first memory were successfully written to the second memory. Also if desired, the processing unit 22 could then optionally signal 65 to a user that the copying process has been successfully completed. For example, the display 31 of the user interface 23 could be used to present such information and/or an audible signal, such as a tone having a characteristic pitch and/or length could be used for similar purpose. The process then ends 66.

So configured, the working information as contained within a memory of a control device 11 can be readily copied, within the form factor of the control device 11 itself, to a second memory. That second memory can then be removed as stored or used as appropriate to effect information backup and/or propagation practices. In this way, lengthy and tedious reprogramming (or initial programming of new or replacement units) can be easily avoided. In addition, the accuracy of the results will typically be more readily assured than by newly reprogramming authorized transmitter information into the control device 11.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. For example, in some systems 10, a previously registered transmitter may temporarily be blocked from authorized use. For example, a given transmitter known to belong to an individual who has left for a two week vacation can be blocked such that an the transmitter can not be used during that period of time, presumably by an unauthorized user, to gain access through the controlled passage. Such blocking status is readily storable in the memory of the control device 11 and is also readily transferable to the second memory during the copying process described above so that the resultant clone will also be able to block access to such transmitters notwithstanding their otherwise registered status. As another example, additional memory interfaces may be provided to support simultaneous creation of more than one cloned memory module.

Also, the embodiments described above are illustrated in the context of a movable barrier control system. There are many other instances and contexts (such as, for example, a telephone-based entry system) that can make similar beneficial use of the inventive concepts illustrated here. The scope of the invention should not be viewed as being limited to the movable barrier scenario.

We claim:

1. A movable barrier control device operably coupleable to a movable barrier operator to facilitate control of the movable barrier operator, the movable barrier control device comprising:

a housing;

a processing unit disposed within the housing and providing at least one control signal from time to time to the movable barrier operator;

a first memory physical interface disposed within the housing and being operably coupled to the processing unit;

a second memory physical interface disposed within the housing and being operably coupled to the processing unit;

a cloning program executable at least in part by the processing unit to cause the processing unit to copy the contents of a first memory that is removably coupled to the first memory physical interface to a second memory that is removably coupled to the second memory physical interface wherein a first easily removable memory is removably coupled to the first memory physical interface; wherein the first easily removable memory has data stored therein comprising identifying information that corresponds to a plurality of radio transmitters; wherein the plurality of radio transmitters comprise wireless movable barrier remote controllers.

2. The control device of claim 1 wherein the processing unit comprises a microprocessor.

3. The control device of claim 1 wherein the first memory physical interface includes at least one temporary conductive lead socket.

4. The control device of claim 1 wherein the first and second memory physical interface each includes at least one temporary conductive lead socket.

5. The control device of claim 1 and further comprising a user interface operably coupled to the processing unit.

6. The control device of claim 5 wherein the cloning program is responsive to the user interface.

7. The control device of claim 1 wherein the data uniquely identifies no more than 250 individual radio transmitters.

8. The control device of claim 1 wherein the data further includes information identifying individual radio transmitters that are blocked from controlling a corresponding movable barrier.

* * * * *